US005304275A

United States Patent [19]

Lowe

[11] Patent Number: 5,304,275

[45] Date of Patent: Apr. 19, 1994

[54] APPLYING A REINFORCEMENT FILM TO SHEETS

[75] Inventor: William Lowe, Bridgehampton, N.Y.

[73] Assignee: E-Z Machine Corp., Farmingdale, N.Y.

[21] Appl. No.: 25,981

[22] Filed: Mar. 3, 1993

[51] Int. Cl.[5] ..... B26D 5/00

[52] U.S. Cl. ..... 156/270; 156/64; 156/202; 156/355; 156/364; 156/479; 156/522

[58] Field of Search ..... 156/202, 270, 64, 355, 156/361, 362, 479, 522, 364, 363

[56] References Cited

U.S. PATENT DOCUMENTS

| | | | |
|---|---|---|---|
| 3,926,713 | 12/1975 | Lowe | 156/510 |
| 4,278,488 | 7/1981 | Kopacz et al. | 156/351 |
| 4,680,079 | 7/1987 | Tanaka | 156/364 X |
| 4,698,114 | 10/1987 | Lowe | 156/353 |
| 4,714,504 | 12/1987 | Cummings et al. | 156/522 X |
| 4,985,096 | 1/1991 | Bekker-Madsen | 156/364 X |
| 4,986,864 | 1/1991 | Heim et al. | 156/202 X |

*Primary Examiner*—David A. Simmons
*Assistant Examiner*—Mark A. Osele
*Attorney, Agent, or Firm*—Herbert Dubno; Andrew Wilford

[57] ABSTRACT

A reinforcing strip is applied to sheets by longitudinally advancing a leading sheet while the strip is adhered to it along a travel path to a downstream stop station and thereby drawing the strip from a supply and extending it longitudinally through an upstream stop station while simultaneously adhering the strip to the full length of the leading sheet. Then the leading sheet is arrested in the downstream stop station while a trailing sheet upstream of the arrested leading sheet is advanced downstream until a leading edge of the trailing sheet engages an upstream stop in the upstream station immediately upstream of a trailing edge of the leading sheet. The trailing sheet is then arrested with its leading edge engaging the upstream stop which it pushes downstream against the upstream edge of the leading sheet. Generally simultaneously the strip is adhered upstream of the upstream stop to the trailing sheet and the strip is severed at the upstream stop between the leading and trailing sheets. The leading sheet is then advanced longitudinally away from the upstream stop and the upstream stop is moved out of the path to longitudinally advance the trailing sheet downstream while the strip is adhered to it to the downstream stop station while drawing the strip from the supply and extending the strip through the upstream stop station. The cycle is repeated with the trailing sheet taking the place of the leading sheet and with another sheet following the trailing sheet and taking its place.

11 Claims, 3 Drawing Sheets

APPLYING A REINFORCEMENT FILM TO SHEETS

FIELD OF THE INVENTION

The present invention relates to the application of a reinforcement film to a sheet. More particularly this invention concerns an automatic method and apparatus that applies such a reinforcement file to the edge of a succession of paper sheets for forming index cards, file folders, or the like.

BACKGROUND OF THE INVENTION

It is common practice in the paper art to reinforce of the edge of a sheet subjected to considerable use or stress by applying a segment of a reinforcing film to the edge. A good example of such apparatus is disclosed in U.S. Pat. No. 4,698,114.

A serious limitation of this apparatus as well as with other similar apparatuses stems from the fact that separate standard sheets vary in length. As a result, the sequence of operations is frequently disturbed and the reinforced sheets are delivered with cut edges or with severed reinforcing-film segments having lengths greater than the sheets they are adhered to. Recalibrating the known machines for use with sheets of a different length is an onerous task involving resetting various cams, timers, stops, and the like.

Another disadvantage of the known machines is that the rely on complex timing and control equipment. Thus if a sheet jams the machine may continue to operate, spoiling numerous work-pieces and jamming itself with material. Alternately if there is a sheet misfeed and a sheet is not fed, the machine may shut down, waiting for an operator to fix the problem, if necessary, and restart it.

OBJECTS OF THE INVENTION

It is therefore an object of the present invention to provide an improved system for attaching reinforcing strips to sheets.

Another object is the provision of such an improved system for attaching reinforcing strips to sheets which overcomes the above-given disadvantages, that is which operates surely and accurately, and that is not subject to shutdown or jamming in the event of a misfeed or similar minor problem.

SUMMARY OF THE INVENTION

A reinforcing strip is applied to sheets by longitudinally advancing a leading sheet while the strip is adhered to it along a travel path to a downstream stop station and thereby drawing the strip from a supply and extending it longitudinally through an upstream stop or working station while simultaneously adhering the strip to the full length of the leading sheet. Then the leading sheet is arrested in the downstream stop station while a trailing sheet upstream of the arrested leading sheet is advanced downstream until a leading edge of the trailing sheet engages an upstream stop in the upstream station immediately upstream of a trailing edge of the leading sheet and pushes this stop downstream against the trailing edge of the leading sheet, leaving about 0.005" between the two edges. The trailing sheet is then arrested with its leading edge engaging the upstream stop. Generally simultaneously the strip is adhered upstream of the upstream stop to the trailing sheet and the strip is severed at the upstream stop between the leading and trailing sheets. The leading sheet is then advanced longitudinally away from the upstream stop and the upstream stop is moved out of the path to longitudinally advance the trailing sheet downstream while the strip is adhered to it to the downstream stop station while drawing the strip from the supply and extending the strip through the upstream stop station. The cycle is then repeated with the trailing sheet taking the place of the leading sheet and with another sheet following the trailing sheet and taking its place.

This system therefore does not rely on complicated timers and the like to determine the sequence of production, but instead the sheet workpieces themselves trigger the appropriate steps when they move into the right positions. To change form length, the operator need merely change the longitudinal spacing between the upstream stop and a stop in the downstream station. This single adjustment is all that is needed; the other steps all will take place automatically at the right time for the new longer or shorter workpieces.

The upstream stop can pivot to allow the severed ends of the reinforcing-film segments to maintain a consistent position relative to the leading and trailing edges of the work-pieces, regardless of minor variations in sheet size.

According to this invention the sheets are urged continuously longitudinally downstream, for instance by continuously advancing belts, and are arrested in the downstream station by a downstream stop engageable across the path. The sheets are longitudinally advanced from the downstream station by moving the downstream stop out of the path.

Furthermore in accordance with this invention a sheet is detected, for instance by a microswitch, immediately downstream of the downstream stop station and the trailing sheet is only released from the upstream station on such detection of a sheet downstream of the downstream stop station. Once again this style of operation eliminated complicated timing devices and ensures perfectly synchronous operation of the machine.

The trailing sheet according to the invention shifts the upstream stop downstream and presses it longitudinally downstream against the trailing edge of the arrested leading sheet when it moves into the upstream station. Only when this stop is pressed against the leading-sheet trailing edge are the cutter and adhering element operated in the upstream station.

The apparatus has according to the invention a conveyor means for displacing a succession of the sheets in an upstream-to-downstream direction along a longitudinal travel path traversing an upstream station and a downstream station such that when the strip is adhered to a leading sheet this strip is extended longitudinally through the upstream station. A roller or the like adheres the strip to the full length of the sheets as same pass from the upstream station to the downstream station, and a downstream stop arrests the sheets one at a time in the downstream station while an upstream stop arrests the sheets one at a time in the upstream station with a leading edge of a sheet arrested in the upstream station immediately upstream of a trailing edge of a sheet arrested in the downstream station. A tack element adheres the strip upstream of the upstream stop to the trailing sheet and a cutter severs the strip at the upstream stop between the leading and trailing edges.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
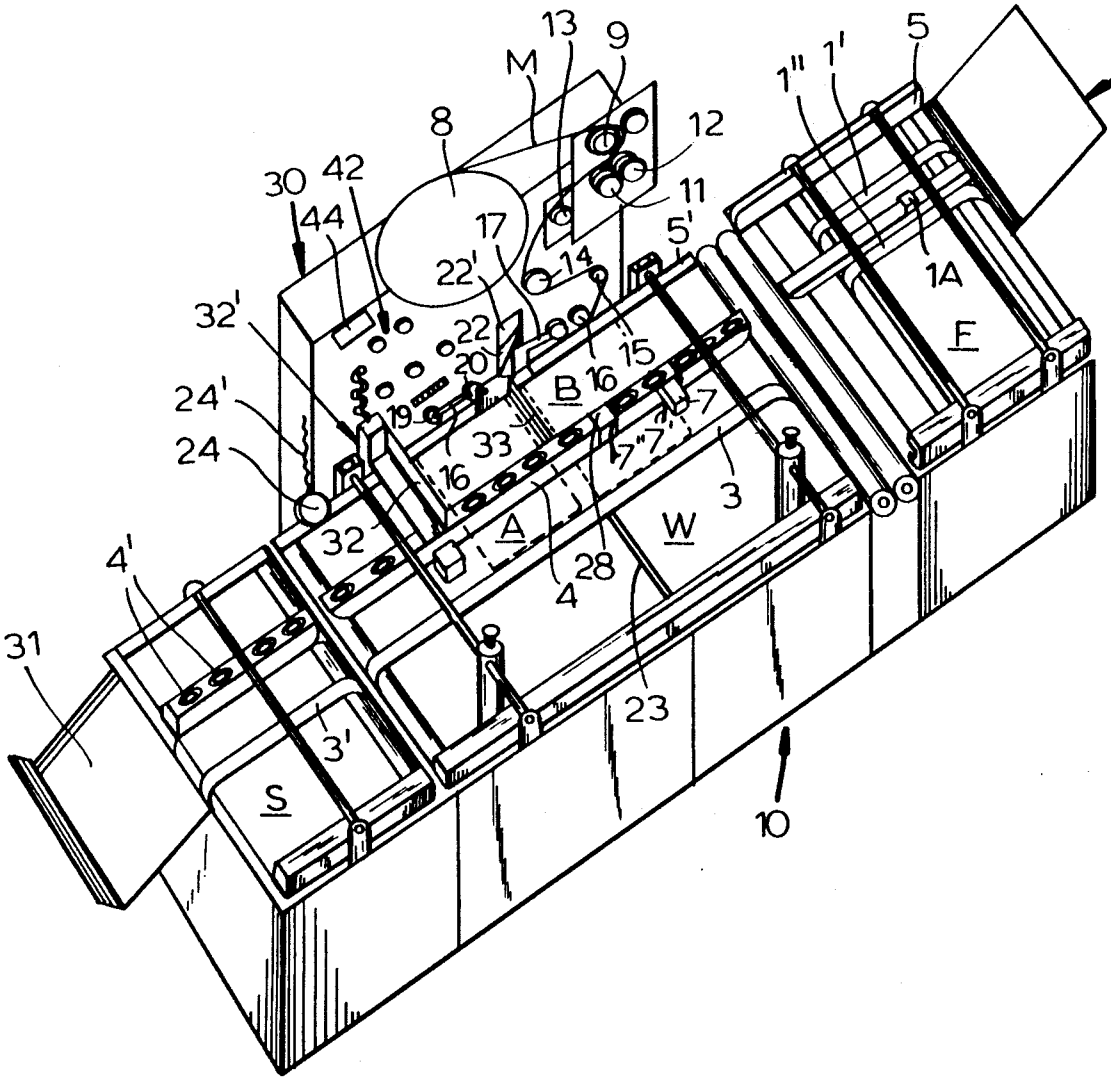
FIG. 1 is a perspective view of the apparatus in a diagrammatic form according to the invention.

As seen in FIG. 1 a reinforcing strip M of polypropylene film is applied to card-stock sheets A and B. A feeder station F is provided at the upstream end of a housing or frame 10 of the apparatus and serves for sequentially delivering the sheets A and B from a paper tray 1 to a working or upstream stop station W. Shafts mounted rotatably on a frame F provide an initial take-off of individual sheets from a stack of sheets stored on the tray 1. In order to insure delivery of separate sheets which tend to adhere to one another a separator 1A is mounted immediately downstream of the tray 1. Should more than one sheet pass the separator IA it produces a signal that generates a visual or audio signal on a control panel 30. While guided by a side guide 5 defining a straight path for the sheets, same are advanced by a plurality of continuously advancing endless belts 1', 1'' mounted on the frame 10 and extending through the working station W.

Figure 3:
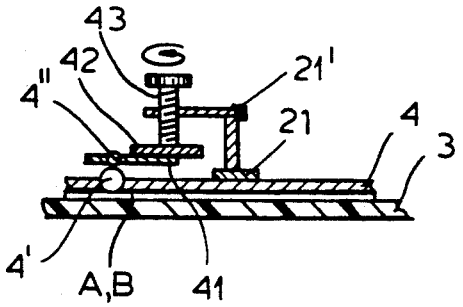
FIG. 3 is a detailed cross sectional view of a pressing device according to the invention.

The working station W performs tacking, cutting, and sealing operations and is formed with a side guide 5', with a plurality of endless conveyor belts 3, and with a pressing rail 4. The rail 4 is provided with a plurality of idle rollers 4' pressing passing sheets against the belts 3. A sensor 7 mounted on the rail 4 generates a signal triggering a subsequent delivery of the sheet B upon passing of the sheet A. A pair of resilient arms 7' assists in guiding the passing sheets toward an upstream stop 33. Downstream from the sensor 7 mounted on the rail 4 is a pressing means formed with a couple of resilient arms 7'' guiding the sheet and a means 28 adapted to vary the pressure with which a roller acts upon the sheets. By regulating the pressure acting on the roller an operator ensures contact between a leading end of the sheet often turned up with the upstream stop 33 (FIG. 3). This contact is critical to successful completion of the whole operation. While design of the means may vary it is essential that the roller 4' be under regulable pressure. In this embodiment as seen in FIG. 3, a pressing roller 4' is in contact with a pressing element 41 connected by means of a plate 42 with regulating element 43 mounted on a base 21 provided with a shoulder 21'. By varying the relative position of the regulating element 43 and the roller 4' either manually or automatically the pressure is changed controllably. A rotatable pin or any other known means can be successfully used as the regulating element 43.

The working station W is provided with the control panel 30 mounted on the frame 10 of the apparatus along the travel path of the sheets. As is seen in FIG. 1 a spool 8 supplies the film strip M guided by rollers 9–16 to a tacking station including a pivotal tack arm 17 and a tack roller 20. The tacking operation is known per se and need not be explained in detail. Suffice it to say that the strip M runs along an application path parallel to the travel path while being applied to opposite sides of the sheet along an edge thereof facing the panel. The tack roller 20 is mounted downstream and spaced from the tack arm. A slot 22' is provided in the panel between the tack roller and tack arm for a cutter 22 severing the strip M in a manner described below.

Figure 1A:
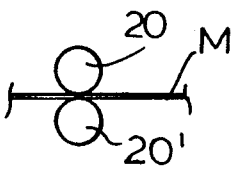
FIG. 1A is a view of a detail of the invention.

The pivotal upstream stop 33 is mounted on the frame 10 and slightly protrudes in a raised or working position above an opening 23 running into the slot 22'. The tack roller 20 is mounted pivotally on a shaft 19 downstream of the slot and provided with a guide arm 18 extending toward the opening 23. Upon further advance of the sheet A along the travel path the tack roller 20 presses the strip M upon the sheet. In order to ensure correct application of such an easily flexible strip M a lower tack roller 20' (FIG. 1A) adapted to be in contact with an inner side of the sheet abutted by the respective folded wing of the strip M is mounted on the frame 10 forming thereby a nip with the upper tack roller 20. The peripheral speed of the roller 20' is identical to that of the belts 3 for true guiding of the sheets. A downstream stop 32 mounted along the travel path interrupts the advancement of the sheet A with the strip M applied thereto and spaced from the upstream stop 33 at distance allowing approximately 1/16 in between a trailing edge of the sheet A and the upstream stop 33 in its rest position. A means 32' is adapted to move the downstream stop 32 transversely to the travel path between the raised rest position and a lowered working position shown and explained further in detail with reference to FIGS. 4A–C. As soon as the cutter 22 severs the strip M between sheets A and B the downstream stop 32 is lifted into its stop position and the sheet A advances further through the pressing or sealing roller 24 urged downward by a spring 24' braced against the panel 30. Holes can be punched in the reinforced sheet edge at this time.

Finally, a storing station S with a hopper 31 mounted at the downstream end of the frame 10 is provided with a plurality of continuously moving endless belts 3' and respective guides leading the finished sheets to the hopper 31.

The apparatus is provided with a pneumatic actuator 44 including a plurality of air cylinders 39 mounted on the frame 10 for pneumatically actuating the cutter 22, tacking element 17, and stops 32 and 33. Control means 42 for monitoring automatic operation of the apparatus and provided with switches and a sheet counter is mounted on the panel 30.

Figure 2:
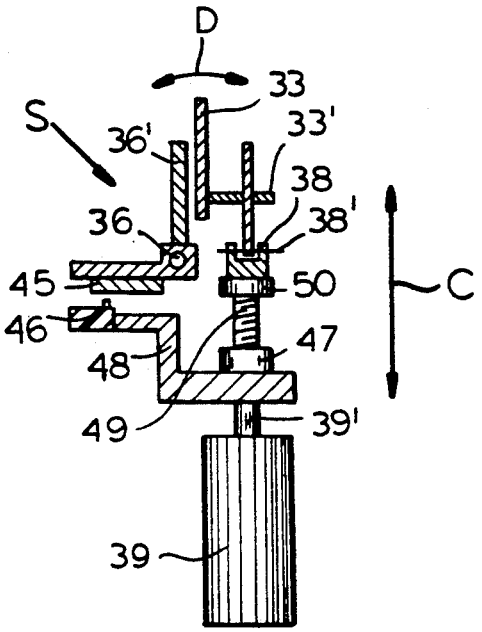
FIG. 2 is a detailed cross sectional view of the upstream stop.

As is mentioned above the upstream stop 33 slightly projects above the opening 23 in its operative engaging position and is pivotally mounted on a U-shaped support 38 shown in FIG. 2. The piston and cylinder unit 39 includes a piston 39' connected with a Z-shaped support 48 effecting vertical displacement of the stop 33 between its rest and engaging positions. Mounted on the support 48 and connected with the piston 39 is a shaft 49 formed with a screwthread. A pair of nuts 47 and 50 are mounted on the shaft 49 for fine adjustment of the upstream stop 33. A U-shaped support 38 connected with the shaft 49 is provided with a pin 33' having a free end connected with the upstream stop 33. Another end of the support 48 is provided with a microswitch 46 for actuating the cutter 22 and tack arm 17 upon engaging of the trailing sheet B with the stop 33. A contact plate 45 is mounted fixed on a pivotal support S including a vertical plate 36' extending parallel to and juxtaposed with the support 33 which is a thin blade deflecting upon contact with the trailing sheet B and pivoting thereby the support S about a fulcrum 36 so that the plate 45 is brought into contact with the switch 46 to actuate it. The upstream stop 33 can also be provided with a plate 33' pivotal on the pin 38' and displacing the upstream stop 33 between first and downstream working positions corresponding respectively to initial engaging with the trailing sheet B and further engaging with a trailing edge of the leading sheet A.

A few possibilities are anticipated for returning the pivotal support S to its starting position after the cutting operation is completed. First, the micro switch can be provided with a spring. Another possibility is a spiral spring mounted on the fulcrum, and finally, the support itself can be designed with an offset center of gravity so the structure returns to its initial position as soon as the upstream stop 33 returns to the rest position.

Figure 4A:
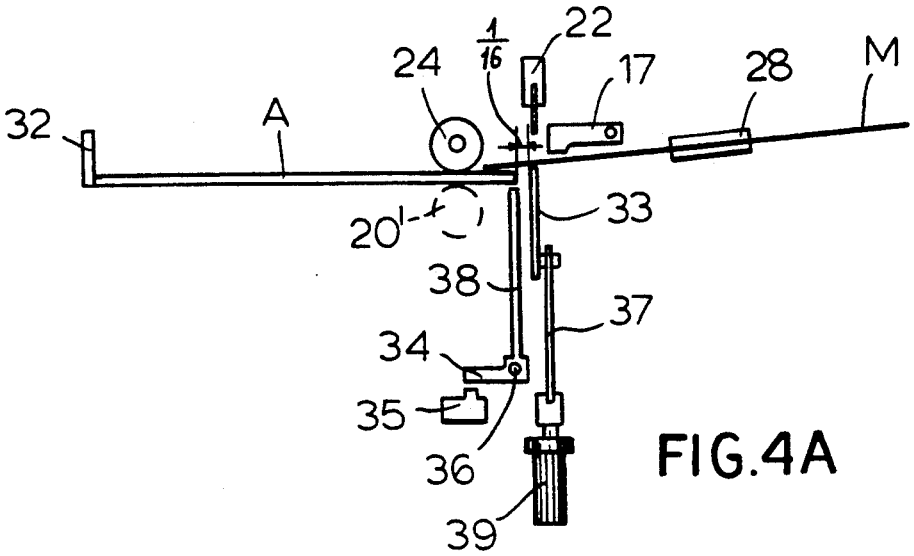
FIGS. 4A–C are elevation views in a diagrammatic form showing in operational sequence the details of the stopping, cutting and tacking station according to the invention.
Figure 4B:
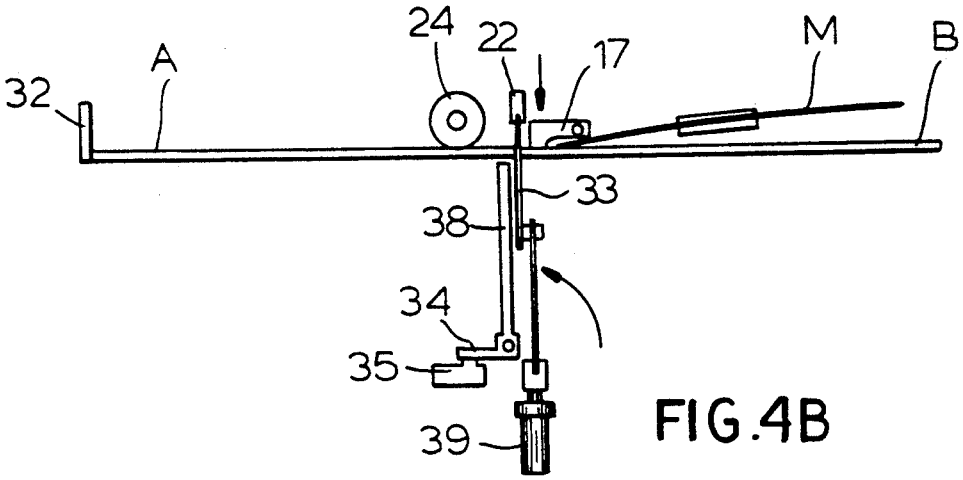
Figure 4C:
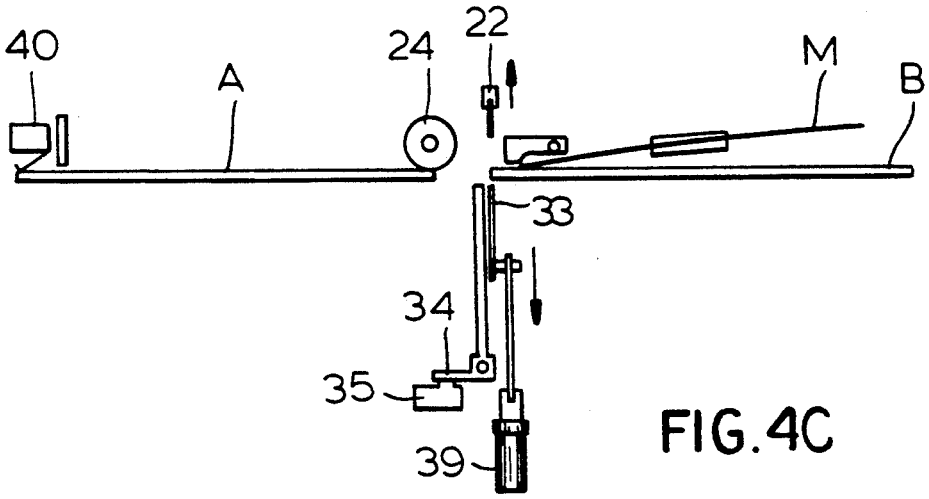

The operation of the apparatus is illustrated in FIGS. 4A–C and is described below.

FIG. 4A illustrates how the sheet A is delivered to the upstream stop 33 with the strip M attached to the edge of the sheet. Upon advancing the sheet A toward the downstream stop 32 the strip M is tacked or adhered to the sheet A by the tack roller 24. The tack arm 17 is in an upper position and does not contact the strip M while the downstream stop 32 is in its stopping position preventing the sheet A from further advancing.

FIG. 4B shows the trailing sheet B delivered toward the first stop 33 swings same toward its working position against the trailing edge of the sheet A. The plate 34 actuates the micro-switch 35, thereby bringing the cutter 22 and tack arm 17 downward either simultaneously or in a preprogrammed sequence with the tack arm 17 lowered first and the cutter 22 thereafter. The cutter 22 is pneumatically actuated by means of a respective air cylinder and is aligned and travels with the stop 33. It has a blade of about 0.005"–0.008" thick and is further movable to a cutting position to severe the strip M between the sheets A and B in a known manner.

FIG. 4C illustrates the step following the cutting step in which the downstream stop 32 is lifted thereby letting the sheet A advance along the travel path. A micro switch 40 is triggered by the advancing sheet A and switches in turn the micro switch 35 restoring initial positions of the upstream stop 33, cutter 22, and tack arm 17.

Upon completing a cycle of operation as described in reference to FIGS. 4A–C a following sheet advances along the travel path, thereby repeating the cycle.

I claim:

1. A method of applying a reinforcing strip to sheets, the method comprising the steps of sequentially:

a) longitudinally advancing a leading sheet while the strip is adhered to it along a travel path to a downstream stop station and thereby drawing the strip from a supply and extending it longitudinally through an upstream stop station while simultaneously adhering the strip to the full length of the leading sheet;

b) arresting the leading sheet in the downstream stop station;

c) longitudinally advancing a trailing sheet upstream of the arrested leading sheet until a leading edge of the trailing sheet engages an upstream stop in the upstream station immediately upstream of a trailing edge of the leading sheet;

d) arresting the trailing sheet with its leading edge engaging the upstream stop immediately upstream of the trailing edge of the leading sheet;

e) generally simultaneously adhering the strip upstream of the upstream stop to the trailing sheet starting at its leading edge and severing the strip at the upstream stop between the leading and trailing sheets;

f) longitudinally advancing the leading sheet downstream away from the upstream stop;

g) moving the upstream stop out of the path and longitudinally advancing the trailing sheet downstream while the strip is adhered to it to the downstream stop station while drawing the strip from the supply and extending the strip through the upstream stop station; and h) repeating steps b) through g) with the trailing sheet taking the place of the leading sheet and with another sheet following the trailing sheet and taking its place.

2. The strip-applying method of claim 1 wherein the sheets are urged continuously longitudinally downstream and are arrested in step b) by a downstream stop engageable across the path and are longitudinally advanced in step f) by moving the downstream stop out of the path.

3. The strip-applying method of claim 1, further comprising the step of f') detecting a sheet immediately downstream of the downstream stop station and only performing step g) on such detection of a sheet downstream of the downstream stop station.

4. The strip-applying method of claim 1 wherein in step c) the trailing sheet shifts the upstream stop downstream and presses it longitudinally downstream against the trailing edge of the arrested leading sheet and step e) is only triggered when the upstream stop is thus shifted downstream, the longitudinal spacing between the upstream edge of the leading sheet and the downstream edge of the trailing sheet being equal to a longitudinal thickness of the stop.

5. An apparatus for applying a reinforcing strip to sheets, the apparatus comprising:

conveyor means for displacing a succession of the sheets in an upstream-to-downstream direction along a longitudinal travel path traversing an upstream station and a downstream station such that when the strip is adhered to a leading sheet this strip is extended longitudinally through the upstream station;

means for adhering the strip to the full length of the sheets as same pass from the upstream station to the downstream station;

means including a downstream stop for arresting the sheets one at a time in the downstream station;

means including an upstream stop for arresting the sheets one at a time in the upstream station with a leading edge of a sheet arrested in the upstream station immediately upstream of a trailing edge of a sheet arrested in the downstream station; and means including a tack element for adhering the strip upstream of the upstream stop to the trailing sheet and a cutter for severing the strip at the upstream stop between the leading and trailing edges.

6. The strip-applying apparatus defined in claim 5 wherein the upstream stop is limitedly longitudinally movable between a downstream end position engaging the trailing edge of a sheet arrested in the downstream station and an upstream end position upstream therefrom, the apparatus further comprising control means including a position-detecting switch associated with the upstream stop for initiating operation of the tack element and cutter on displacement of the upstream stop into the downstream position.

7. The strip-applying apparatus defined in claim 6 wherein the upstream stop is pivotal between its end positions.

8. The strip-applying apparatus defined in claim 5, further comprising control means including a switch immediately downstream of the downstream stop for detecting the presence of a sheet immediately downstream of the downstream stop and for initiating displacement of the upstream stop out of the path on such detection of a sheet immediately downstream of the downstream stop.

9. The strip-applying apparatus defined in claim 5 wherein each of the stops is displaceable between a position engaged across the path and blocking movement of the sheets along the path and a position offset therefrom and permitting movement of the sheets along the path.

10. The strip-applying apparatus defined in claim 5 wherein the conveyor means includes continuously moving transport belts engaging the sheets and continuously urging sam longitudinally downstream.

11. The strip-applying apparatus defined in claim 5 wherein the means for adhering includes at least one roller immediately downstream of the upstream stop and pressing the strip down against the sheets as same pass.

* * * * *